US009187869B2

(12) United States Patent
Rainey

(10) Patent No.: US 9,187,869 B2
(45) Date of Patent: Nov. 17, 2015

(54) PRECAST LEVELING SEGMENT BELOW A TRAFFIC BARRIER ATOP AN EARTH RETAINING WALL SYSTEM

(71) Applicant: Earth Wall Products, LLC, Marietta, GA (US)

(72) Inventor: Thomas L. Rainey, Marietta, GA (US)

(73) Assignee: Earth Wall Products, LLC, Marietta, GA (US)

( * ) Notice: Subject to any disclaimer, the term of this patent is extended or adjusted under 35 U.S.C. 154(b) by 0 days.

(21) Appl. No.: 14/177,342

(22) Filed: Feb. 11, 2014

(65) Prior Publication Data

US 2014/0234025 A1 Aug. 21, 2014

Related U.S. Application Data

(60) Provisional application No. 61/766,794, filed on Feb. 20, 2013, provisional application No. 61/914,127, filed on Dec. 10, 2013.

(51) Int. Cl.
*E01F 15/08* (2006.01)

(52) U.S. Cl.
CPC ..... *E01F 15/083* (2013.01)

(58) Field of Classification Search
CPC ..... E01F 15/083; E01F 15/146; E01F 15/02; E01F 13/12
USPC ..... 404/6
See application file for complete search history.

(56) References Cited

U.S. PATENT DOCUMENTS 4,494,892 A * 1/1985 Wojciechowski ..... 404/6
4,684,287 A * 8/1987 Wojciechowski ..... 405/287
5,443,324 A * 8/1995 Sullivan ..... 404/6
5,468,098 A * 11/1995 Babcock ..... 405/262
5,471,811 A * 12/1995 House et al. ..... 52/745.1
5,492,438 A * 2/1996 Hilfiker ..... 405/285
6,792,731 B2 * 9/2004 Bott et al. ..... 52/603

(Continued)

FOREIGN PATENT DOCUMENTS

GB 112 084 A 12/1917
WO 2014/004892 A1 1/2014

OTHER PUBLICATIONS

PCT International Search Report and Written Opinion in co-pending, related PCT Application No. PCT/US2014/015660, mailed Jun. 5, 2014.

(Continued)

*Primary Examiner* — Abigail A Risic
(74) *Attorney, Agent, or Firm* — Thomas | Horstemeyer, LLP

(57) ABSTRACT

Disclosed herein are embodiments of a roadside barrier segment to sit on top of a retaining wall to provide impact resistance to vehicular traffic. Concrete traffic barriers are pre-cast in a controlled manufacturing environment then transported as a modular precast concrete segment to the jobsite and installed interlocking directly on top of an earth retaining wall. The precast concrete segment is designed to have a counterweight from soil backfill on a stem of the precast segment that resists overturning pressures from vehicle impact on the traffic barrier segment that extends above the roadway surface. The stem may be triangular in shape to capture more of the backfill soil. A vertical node may be placed on one side of the segment and a receiving channel on the opposite side of the segment to allow the interaction of adjacent segments to share impact loads from motor vehicles.

18 Claims, 16 Drawing Sheets

(56) References Cited

U.S. PATENT DOCUMENTS

| | | | | |
|---|---|---|---|---|
| 7,614,830 | B1 * | 11/2009 | Ritke | 405/286 |
| 7,695,268 | B2 | 4/2010 | Klettenberg | |
| 2003/0074856 | A1 | 4/2003 | Hammer | |
| 2011/0318100 | A1 | 12/2011 | Rainey | |
| 2012/0121324 | A1 * | 5/2012 | Rodriguez | 404/6 |
| 2012/0151862 | A1 | 6/2012 | Daoust | |

OTHER PUBLICATIONS

PCT International Preliminary Report on Patentability in co-pending, related PCT Application No. PCT/US2014/015660, mailed Jan. 16, 2015.

* cited by examiner

PRECAST LEVELING SEGMENT BELOW A TRAFFIC BARRIER ATOP AN EARTH RETAINING WALL SYSTEM

CROSS-REFERENCE TO RELATED APPLICATION

This application claims priority to U.S. provisional application entitled, "Precast Traffic Barrier Segment Atop Retaining Wall System," having application No. 61/766,794, filed Feb. 20, 2013, and U.S. provisional application entitled, "Precast Leveling Segment Below a Traffic Barrier Atop an Earth Retaining Wall System," having application No. 61/914,127, filed Dec. 10, 2013, and, both of which are entirely incorporated herein by reference.

BACKGROUND

Precast concrete earth retaining walls are commonly used for architectural, site development and roadway/highway construction applications. When roadways are located above or rest on top of the completed earth retaining wall, a traffic barrier segment is required to prevent vehicles from falling off of the retaining wall. Therefore, a traffic barrier segment is required to contain the impact from vehicles to keep them from falling over the retaining wall.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Disclosed herein various embodiments of precast traffic barrier segments that are designed to rest above an earth retaining wall of precast segments to prevent traffic from falling over the retaining wall. The objective of the current invention is to allow a uniform height precast traffic barrier be installed parallel and to the alignment grade of the proposed roadway grade above the wall even though the supporting retaining wall is constructed and installed in parallel uniform height segments along courses of modular precast units. In order to provide a differing height required to follow a roadway grade that varies along the wall length especially in vertical curves of the changing roadway grade, a leveling or variable height course of modular concrete segment block units is required. The current invention, with the use of a tilting table to cast the leveling units at various heights/angles, modifies the immediate course below the uniform height traffic barrier course to allow the traffic barrier to follow the changing vertical grade of the roadway.

When roadways, driveways or vehicle access is planned above an earth retaining wall, a barrier to prevent traffic from falling over the walls leading edge is typically required. Traditionally, a guard rail or poured in place concrete traffic barrier segment is installed above the retaining wall to contain vehicles above the earth retaining wall in the planned drive isle or roadway. The exemplary embodiments expedite installation of the traffic barrier segment by making it a part of the earth retaining wall system where the barrier segment can act as the top row of modular precast retaining wall system and provide resistance to overturning by using the backfill soil weight resting on the horizontal triangular stem. The downward pressure of the soil backfill beside and on top of the horizontal stem provides the resisting pressure to have the exemplary precast traffic barrier segment act as a cantilever foundation/vertical wall and resist impact loads from vehicles on the portion of the barrier segment extending above grade.

Generally speaking, the portion of the traffic barrier segment extending above grade has a shape that varies depending upon a state's rules and regulations (promulgated by the Department of Transportation), which define certain acceptable geometries and dimensions for barrier segments installed along roadways/highways of the state. Therefore, the geometry of the traffic barrier segment's vertical portion extending above roadway grade may vary from state to state.

First Embodiment(s)

Figure 1:
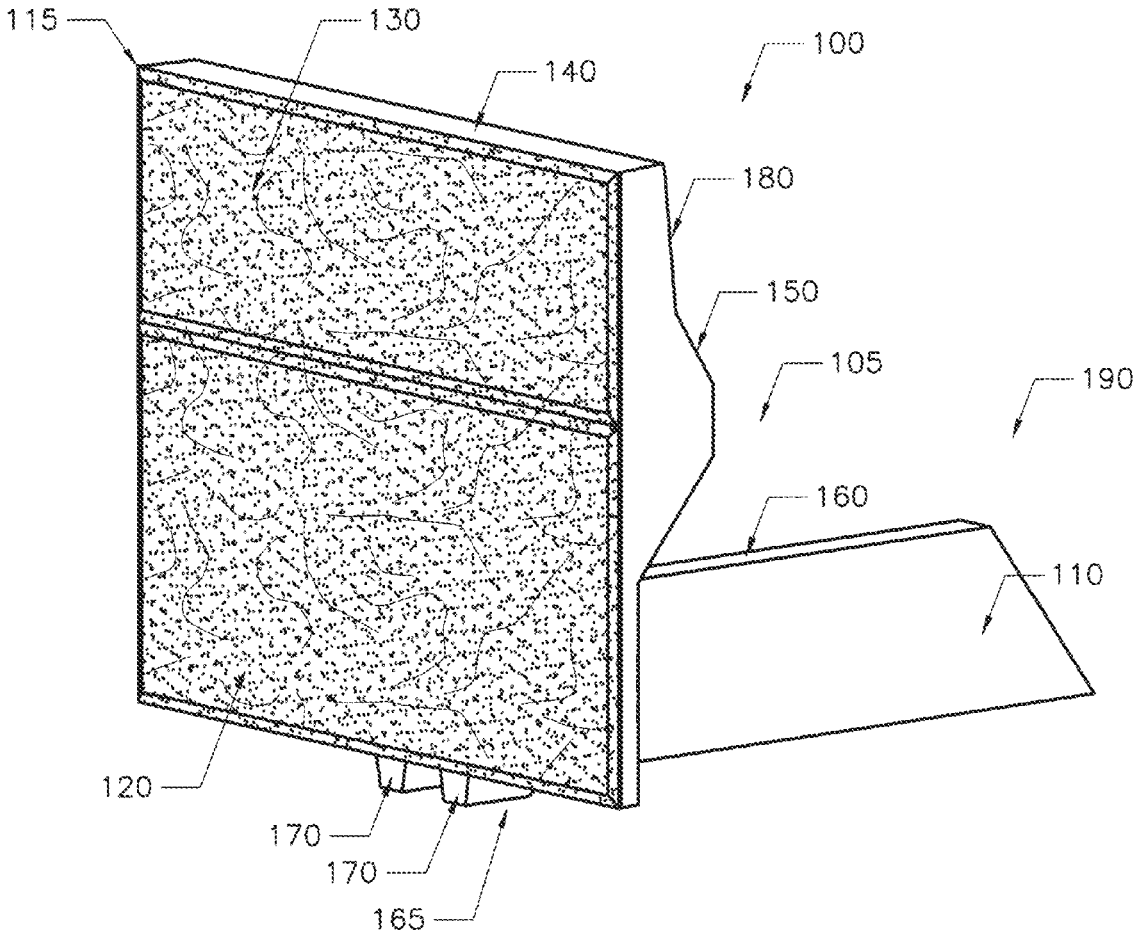
FIG. 1 is a view of the exemplary precast traffic barrier segment in accordance various first embodiments of the disclosure.

Referring to FIG. 1, an exemplary precast traffic barrier segment 100 has a vertical face 130 that extends above roadway grade and a face 120 extending below roadway grade that consists of the upper portion of the underlying earth retaining wall. The top of the barrier segment portion 140 above roadway grade is typically 32 inches above the roadway or driveway surface elevation. The back face of the barrier segment extending above grade is 180 where the vehicular impact would occur as well as the slanted portion 150. The overall stability of the exemplary precast traffic barrier segment is prevented from overturning by a counterweight from backfill soil resting beside and above the rear stem 190. A triangular portion 110 of the rear stem helps capture the surrounding backfill soils weight to add resisting force by means of downward weight on the exemplary traffic barrier segment stem 190. The top of the stem 160 is approximately 30 inches below the drive or roadway grade to allow the installation of utilities and pavement section not obscured by the precast traffic barrier segment piece or segment.

Figure 2:
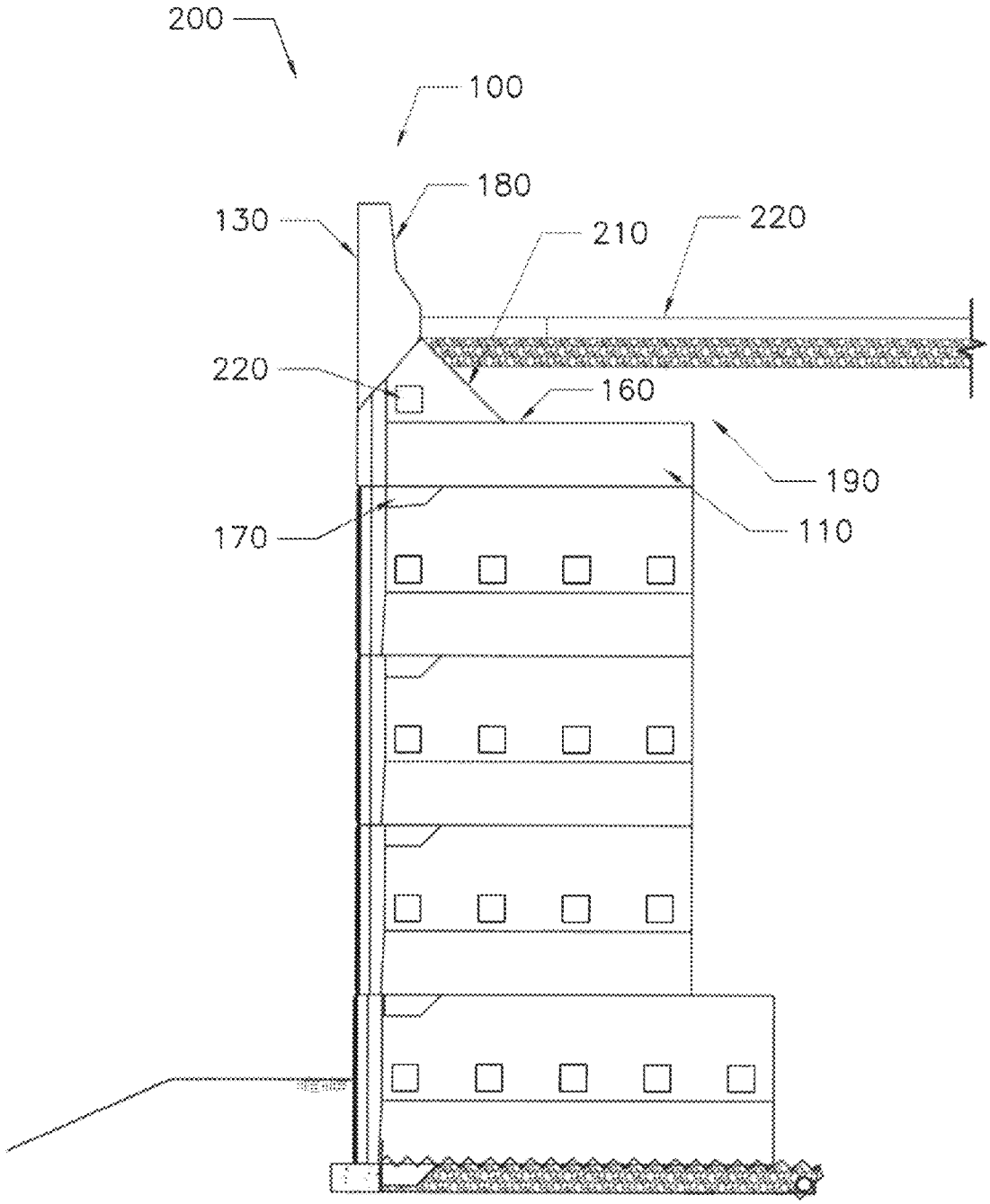
FIG. 2 is a cross sectional view of an earth retaining wall with the exemplary precast traffic barrier segment of FIG. 1 sitting on top of an earth retaining wall in accordance various embodiments of the disclosure.

FIG. 2 shows a cross section 200 of the elevated roadway grade 220 sitting on top of the earth retaining wall. The stem 190 of the exemplary precast traffic barrier segment sits well below the pavement grade 220 to prevent interference. To keep the exemplary precast traffic barrier segment from sliding on top of the retaining wall, two protruding lugs 170 extend below the exemplary traffic barrier segment to lock into the top concrete precast segment of the earth retaining wall. For installation of the exemplary precast traffic barrier segment, a square hole 240 is cast into the exemplary precast traffic barrier segment to facilitate lifting and hoisting into place. A diagonal portion of the stem 210 is required to transfer the downward cantilever pressure on the stem 190 to the vertical portion of the exemplary precast traffic barrier segment to prevent impact on the face 120 of the barrier segment facing vehicular traffic.

Figure 3:
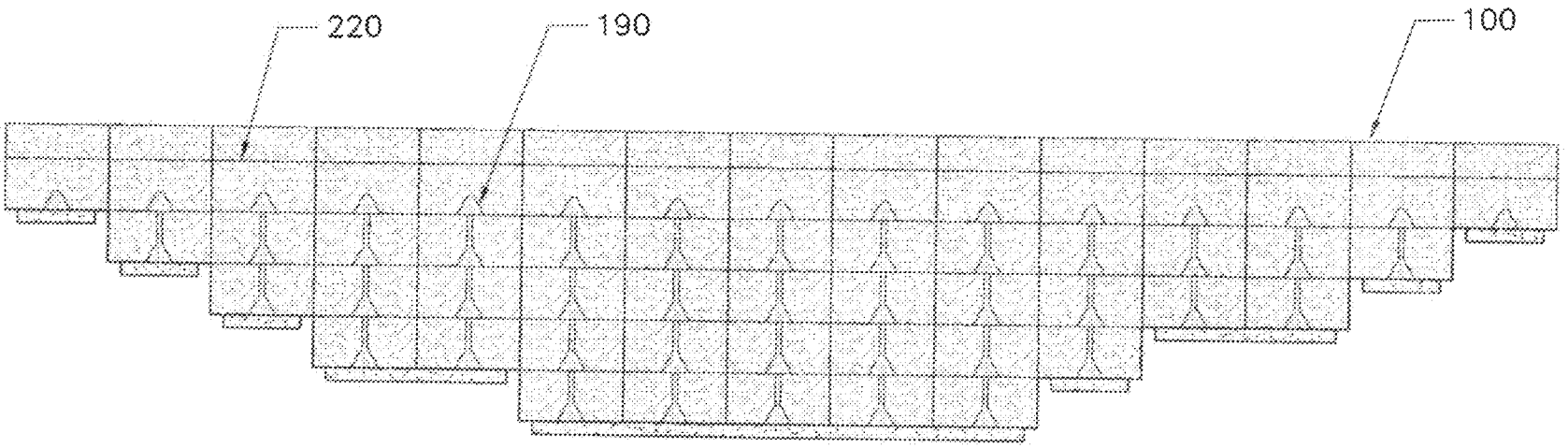
FIG. 3 is an elevation view of an earth retaining wall with the exemplary precast traffic barrier segment of FIG. 1 making up the top row of precast concrete segments in accordance various embodiments of the disclosure.

In looking at an elevation view, FIG. 3, of the front face of the earth retaining wall, the exemplary precast traffic barrier segment 100 makes up the top row of the concrete earth retaining wall to complete or top out the earth retaining wall soil retention requirements. The grade of the proposed roadway 220 is below the barrier segment portion of the precast traffic barrier segment but above the stem portion 190 of the traffic barrier segment.

Figure 4:
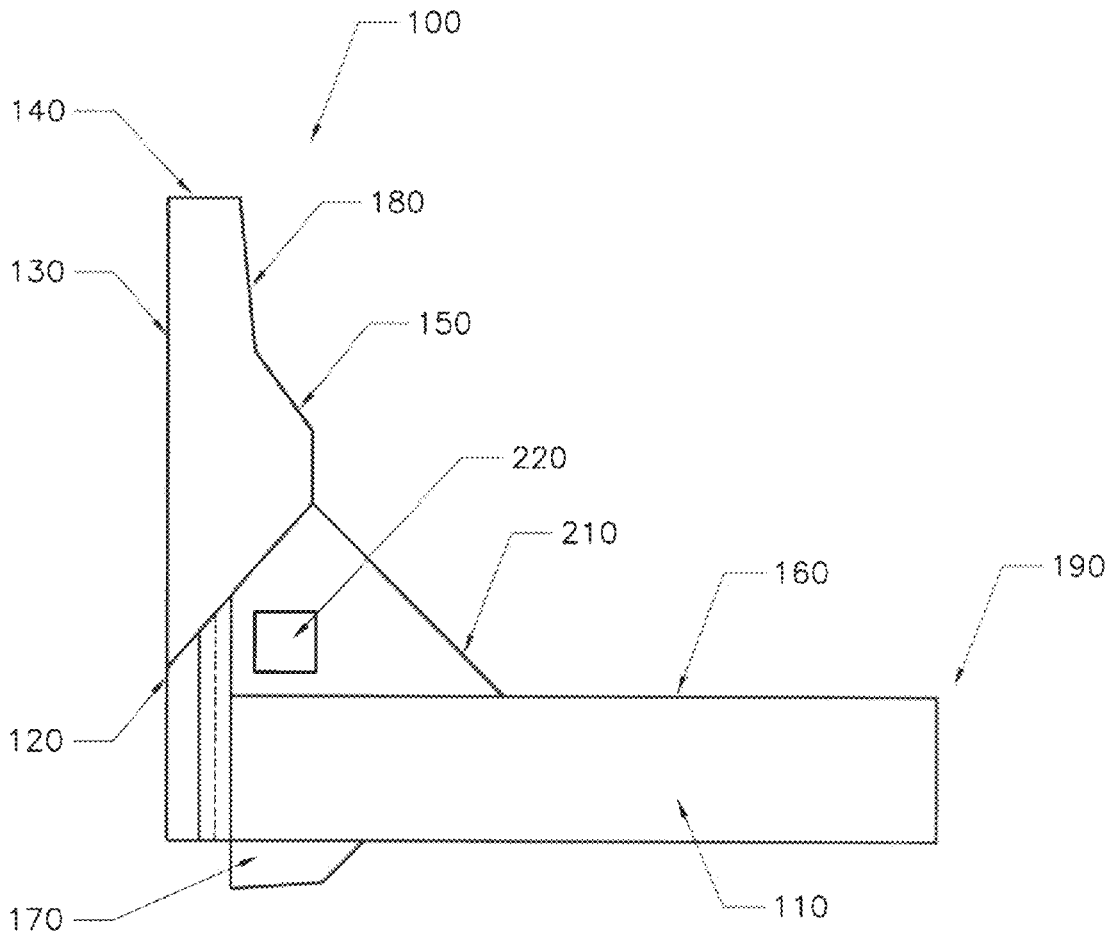
FIG. 4 is a side view of the exemplary precast traffic barrier segment of FIG. 1 in accordance various embodiments of the disclosure.
Figure 5:
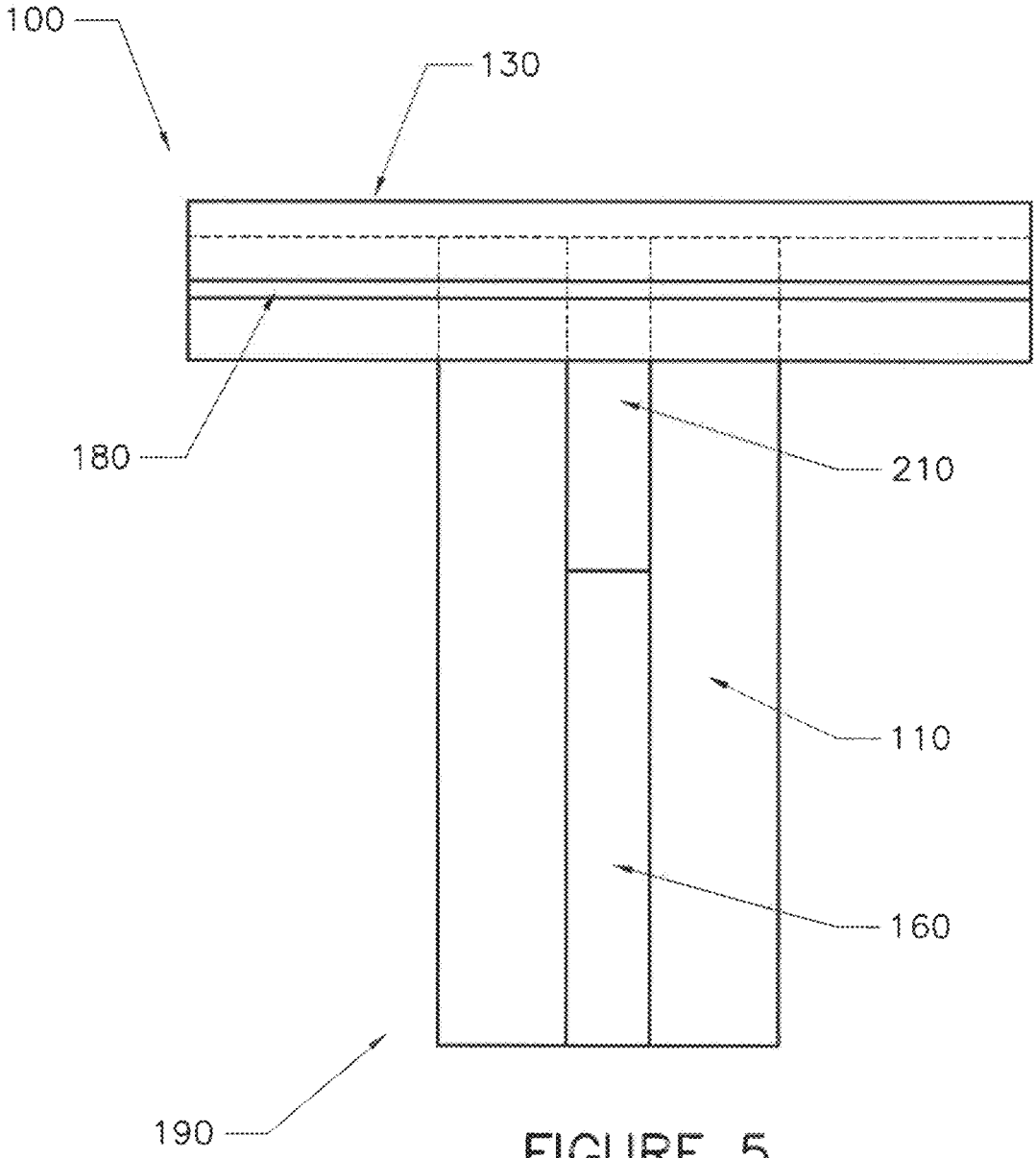
FIG. 5 is a top view of the exemplary precast traffic barrier segment of FIG. 1 in accordance various embodiments of the disclosure.

In FIG. 4, the exemplary precast traffic barrier segment 100 is shown to illustrate the unique features. The lower locking lugs 170 extend below the bottom of the stem 190 to lock into the earth retaining wall system below. The front face 120 of the precast traffic barrier segment is in vertical alignment with the underlying retaining wall face to complete the earth retaining wall vertical plane alignment. FIG. 5 shows the top view to illustrate the triangular sides 110 of the stem 190 cover approximately 50% of the overall counterweight area of backfill soil that is available to provide weight for overturning resistance. The triangular stem portions 110 allow the reduced horizontal coverage area and hence save precast concrete area/volume.

Figure 6:
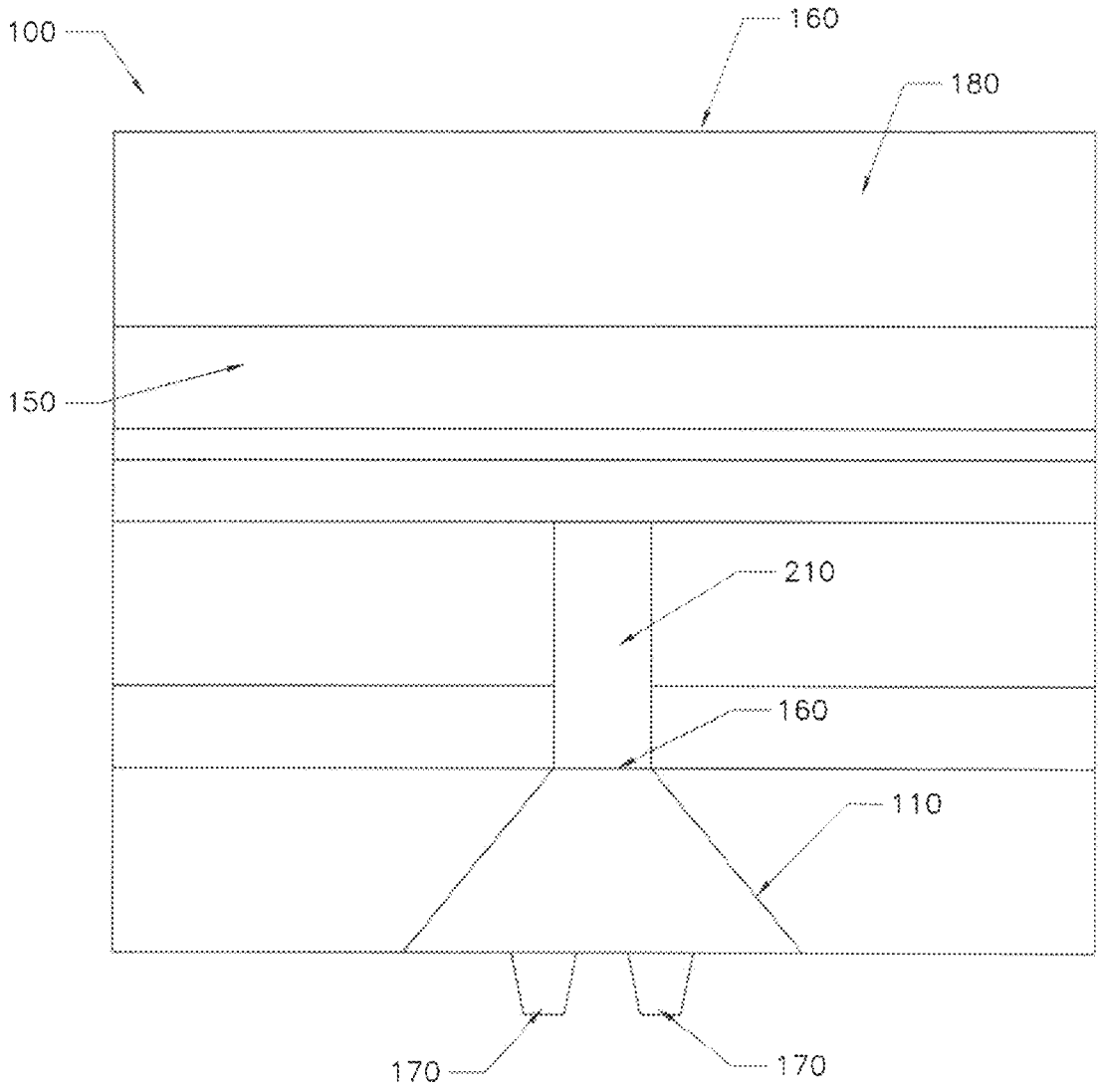
FIG. 6 is a back view of the exemplary precast traffic barrier segment of FIG. 1 in accordance various embodiments of the disclosure.

FIG. 6 is a rear view of the exemplary precast traffic barrier segment 100 which shows the diagonal connection arm 210 from the top of the stem 160 up to the vertical portion of the traffic barrier segment 180 and 150.

It should be emphasized that the above described invention of the present disclosure is to implement an arching effect within the earth retaining wall backfill soils by the triangular stem to take advantage of the soil backfill vertical weight to provide resisting force from horizontal vehicular impact on the portion of the stem above the drive isle or roadway grade. The dimensions of the portion of the barrier segment above grade may vary depending upon various Department of Transportation guidelines for impact barrier segments along roadways.

Second Embodiment(s)

When roadways are located above or rest on top of the completed earth retaining wall, a traffic barrier segment may be required to handle large impact loads from trucks or other large vehicles. The results may be more pressure than the individual segments can resist from overturning and sliding. Therefore, the attachment of one segment to the next horizontally in order to share the impact load may be required. In this instance, a groove is cast in the side of the segment with a slip joint to allow the segments to work together in resisting the impact.

The exemplary embodiment allows the individual segments to carry more impact load by interacting with the adjacent segments to provide more resistance than any one segment can exhibit alone. Also, the grove is such that when setting the segments in place, the adjacent segment slides down over the top to expedite installation of these traffic barrier segments. Also, the groove allows the alignment of the segments to be kept in line so the segments do not protrude out from one another that could snag a vehicle that comes in contact with the wall and slides down the traffic barrier segment impacting several segments in series.

Figure 7:
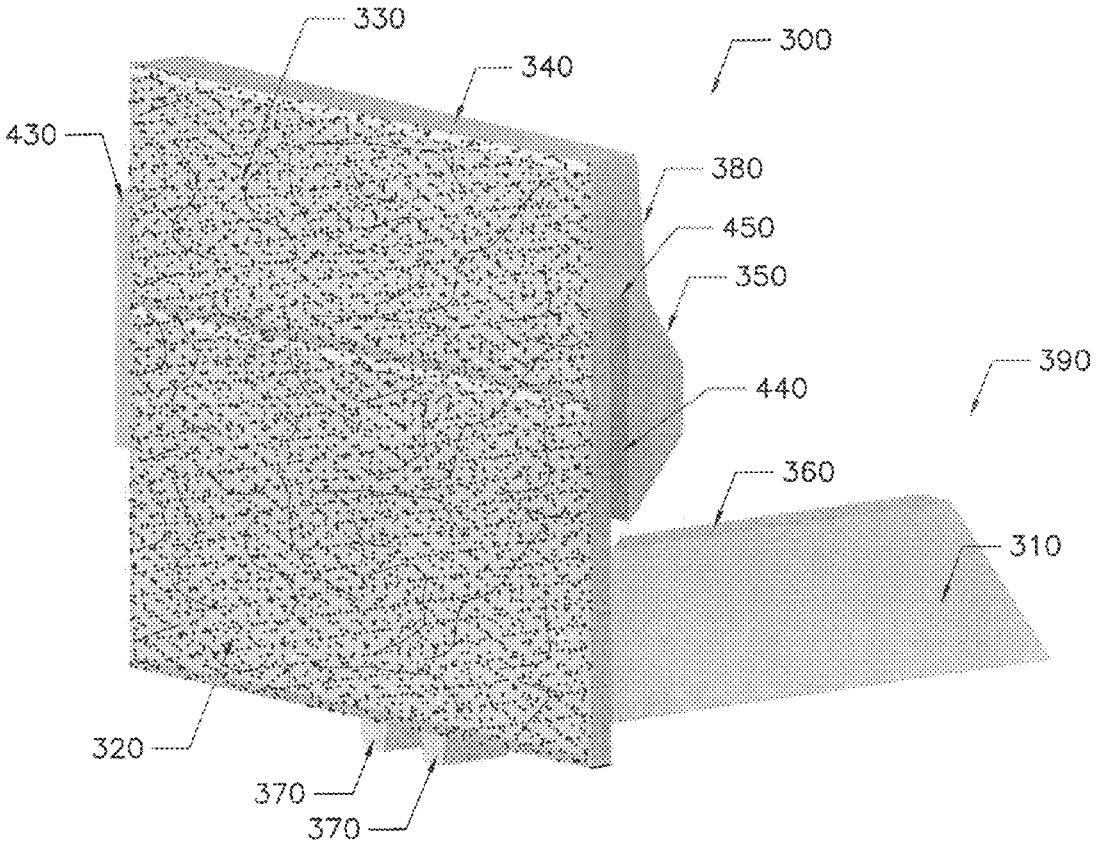
FIG. 7 is a view of the exemplary precast traffic barrier segment that interact with adjacent segments in accordance various second embodiments of the disclosure.

Referring to FIG. 7, the exemplary precast traffic barrier segment 300 has a vertical face 330 that extends above roadway grade and a face 320 extending below roadway grade that consists of the upper portion of the underlying earth retaining wall. The top of the barrier segment portion 340 above roadway grade is typically 36 inches above the roadway or driveway surface elevation. The back face of the barrier segment extending above grade is 380 where the vehicular impact would occur as well as the slanted portion 350. The overall stability of the exemplary precast traffic barrier segment is prevented from overturning by a counterweight from backfill soil resting beside and above the rear stem 390. A triangular portion 310 of the rear stem helps capture the surrounding backfill soils weight to add resisting force by means of downward weight on the exemplary traffic barrier segment stem 390. The top of the stem 360 is approximately 30 inches below the drive or roadway grade to allow the installation of utilities and pavement section not obscured by the precast traffic barrier segment piece or segment. A vertical node 430 protrudes out the side of the segment to fit into the adjoining segments groove 440 to allow interconnectivity. The groove does not extend all the way to the top of the segment but terminates at 450 to not expose the joint and hide from view.

Figure 8:
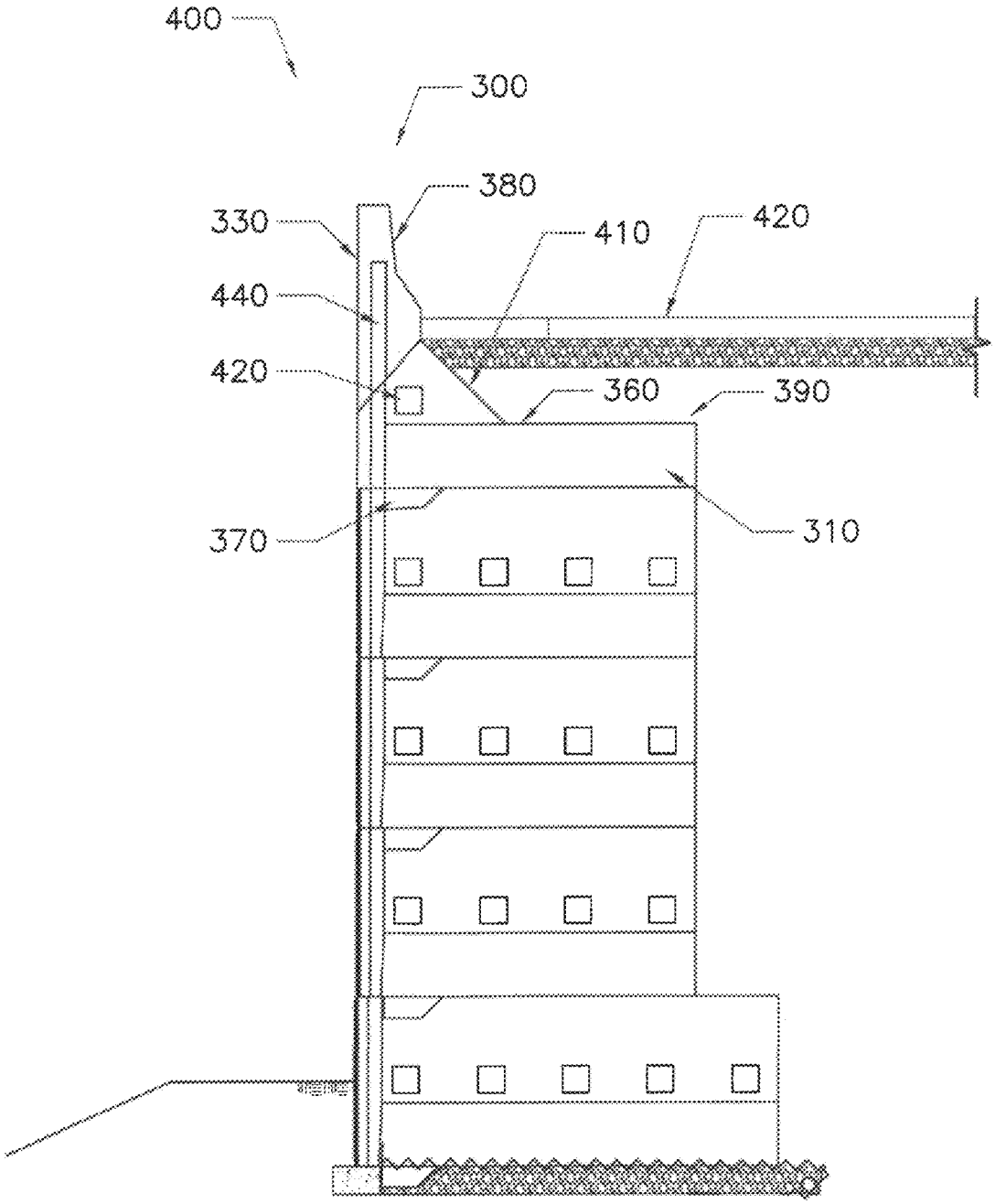
FIG. 8 is a cross sectional view of an earth retaining wall with the exemplary precast traffic barrier segment of FIG. 7 that interact with adjacent segments sitting on top of an earth retaining wall in accordance various embodiments of the disclosure.

FIG. 8 shows a cross section 400 of the elevated roadway grade 420 sitting on top of the earth retaining wall. The stem 390 of the exemplary precast traffic barrier segment sits well below the pavement grade 420 to prevent interference. To keep the exemplary precast traffic barrier segment from sliding on top of the retaining wall, two protruding lugs 370 extend below the exemplary traffic barrier segment to lock into the top concrete precast segment of the earth retaining wall. For installation of the exemplary precast traffic barrier segment, a square hole 420 is cast into the exemplary precast traffic barrier segment to facilitate lifting and hoisting into place. A diagonal portion of the stem 410 is required to transfer the downward cantilever pressure on the stem 390 to the vertical portion of the exemplary precast traffic barrier segment to prevent impact on the face 380 of the barrier segment facing vehicular traffic. The vertical slot 440 receives the adjacent vertical node 430 to interlock and allow connectivity and shared resistance when impacted.

Figure 9:
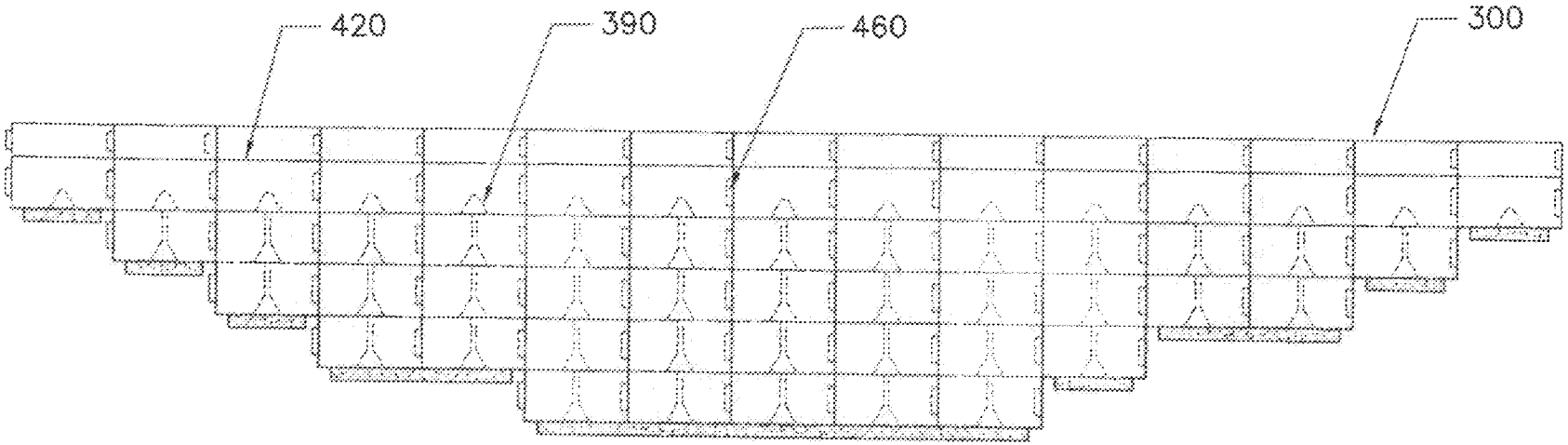
FIG. 9 is an elevation view of an earth retaining wall with the exemplary precast traffic barrier segment of FIG. 7 that interact with adjacent segments making up the top row of precast concrete segments in accordance various embodiments of the disclosure.

In looking at an elevation view, FIG. 9, of the front face of the earth retaining wall, the exemplary precast traffic barrier segment 300 makes up the top row of the concrete earth retaining wall to complete or top out the earth retaining wall soil retention requirements. The grade of the proposed roadway 420 is below the barrier segment portion of the precast traffic barrier segment, but above the stem portion 390 of the traffic barrier segment. The segments connect horizontally by a node and vertical channel 460 to share impact loads from vehicles.

Figure 10:
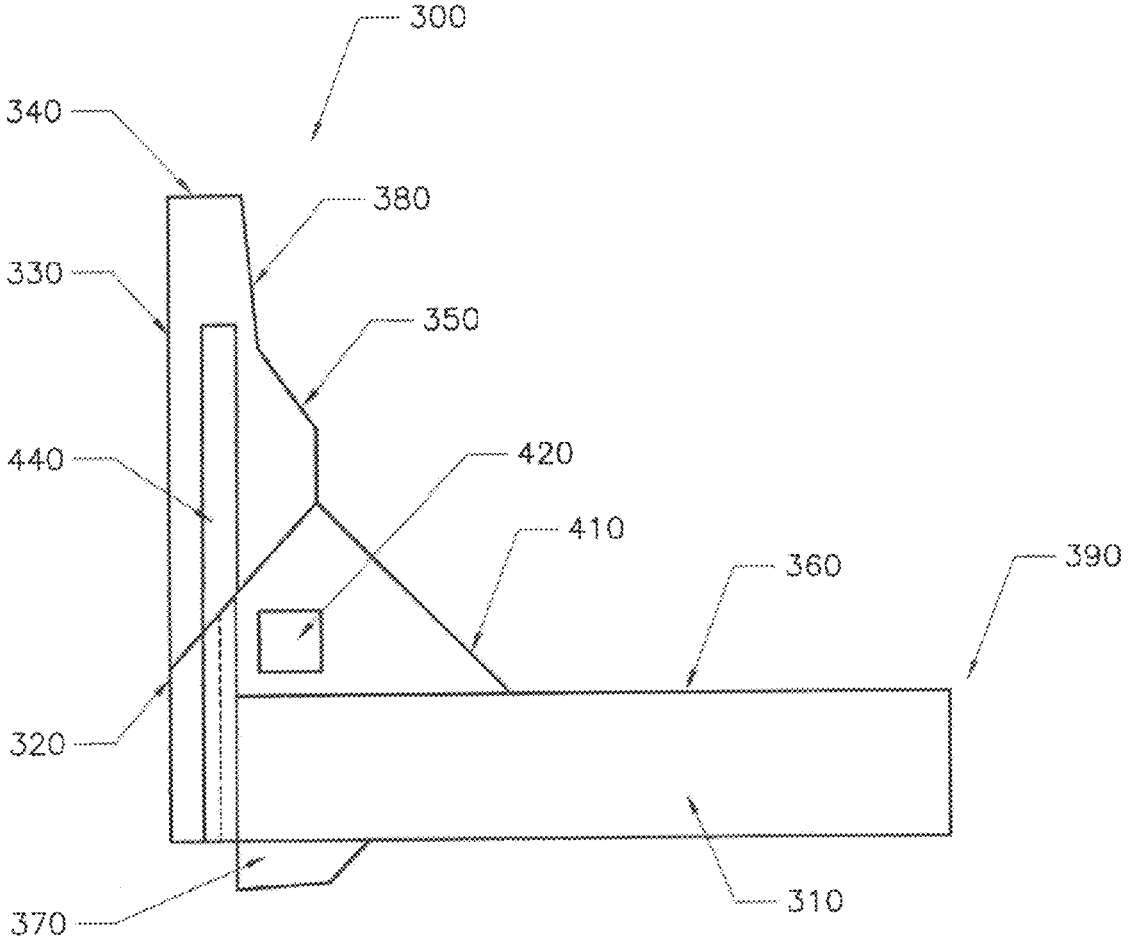
FIG. 10 is a side view of the exemplary precast traffic barrier segment of FIG. 7 that interact with adjacent segments in accordance various embodiments of the disclosure.
Figure 11:
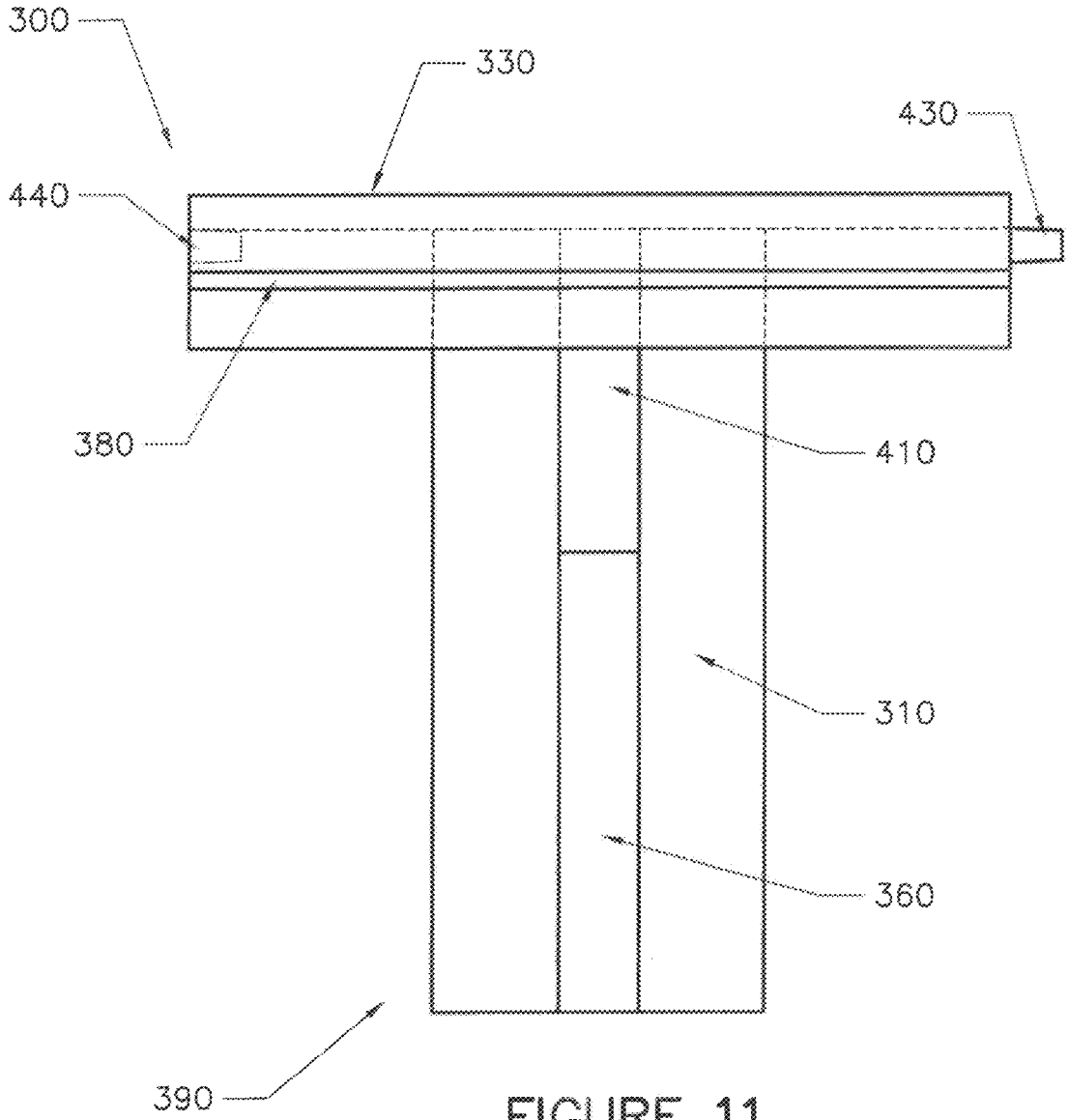
FIG. 11 is a top view of the exemplary precast traffic barrier segment of FIG. 7 that interact with adjacent segments in accordance various embodiments of the disclosure.

In FIG. 10, the exemplary precast traffic barrier segment 300 is shown to illustrate the unique features. The lower locking lugs 370 extend below the bottom of the stem 390 to lock into the earth retaining wall system below. The front face 320 of the precast traffic barrier segment is in vertical alignment with the underlying retaining wall face to complete the earth retaining wall vertical plane alignment. The vertical slot 440 is to receive the vertical node from the adjacent segment. FIG. 11 shows the top view to illustrate the triangular sides 310 of the stem 390 cover approximately 50% of the overall counterweight area of backfill soil that is available to provide weight for overturning resistance. The triangular stem portions 310 allow the reduced horizontal coverage area and hence save precast concrete area/volume. The vertical node 430 extends out the side of the segment to fit inside the adjacent segments vertical slot 440.

Figure 12:
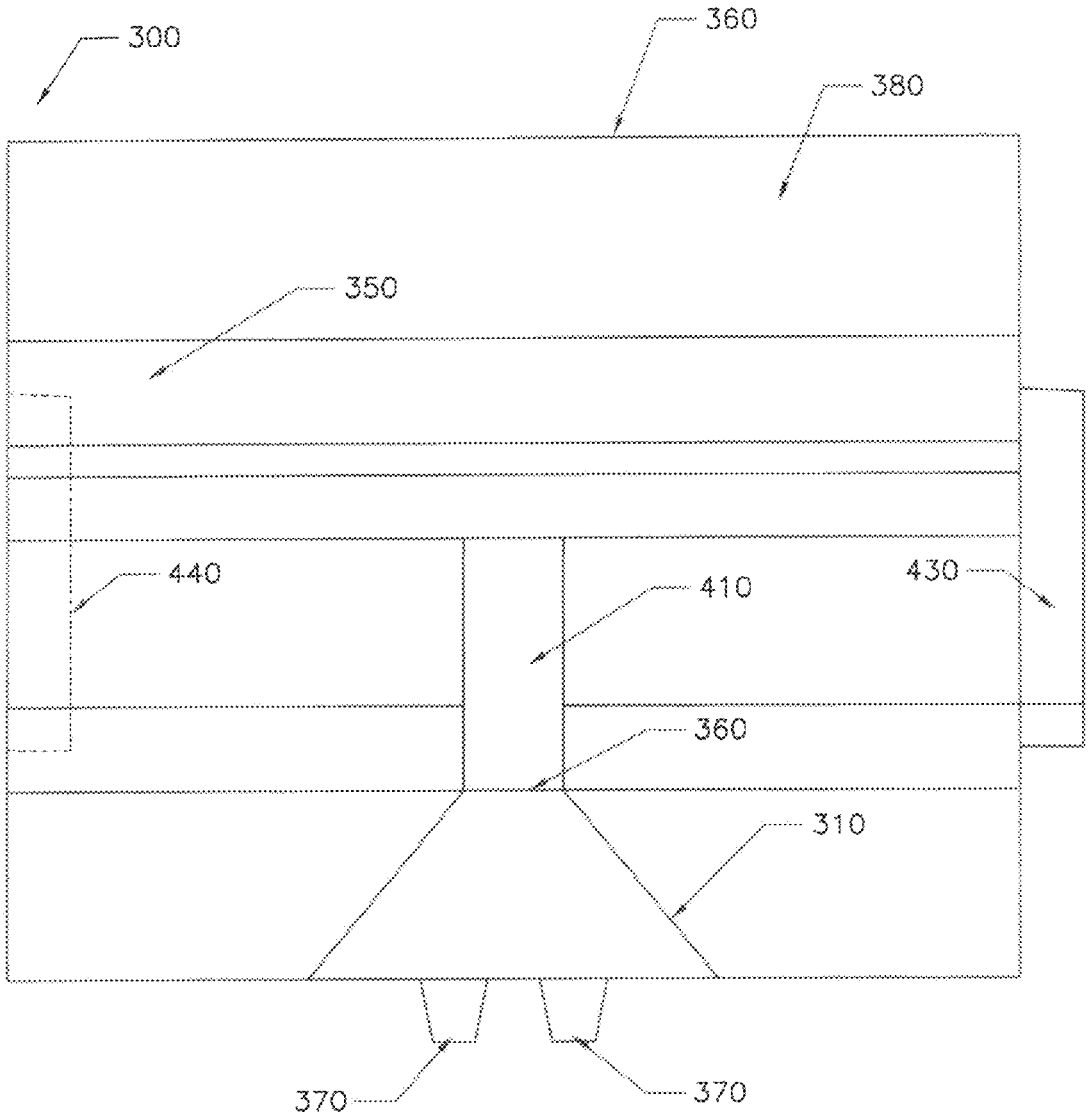
FIG. 12 is a back view of the exemplary precast traffic barrier segment of FIG. 7 that interact with adjacent segments in accordance various embodiments of the disclosure

FIG. 12 is a rear view of the exemplary precast traffic barrier segment 300 which shows the diagonal connection arm 410 from the top of the stem 360 up to the vertical portion of the traffic barrier segment 380 and 350. The vertical node 430 is shown as well as the receiving vertical slot or channel 440.

It should be emphasized that the second embodiment implements an arching effect within the earth retaining wall backfill soils by the triangular stem to take advantage of the soil backfill vertical weight to provide resisting force from horizontal vehicular impact on the portion of the stem above the drive isle or roadway grade. The dimensions of the portion of the barrier segment above grade may vary depending upon various Department of Transportation guidelines for impact barrier segments along roadways. The vertical node on one side and vertical slot or channel on the opposite side allows horizontal interaction of adjacent segments to share vehicle impact loads.

Third Embodiment(s)

Figure 13:
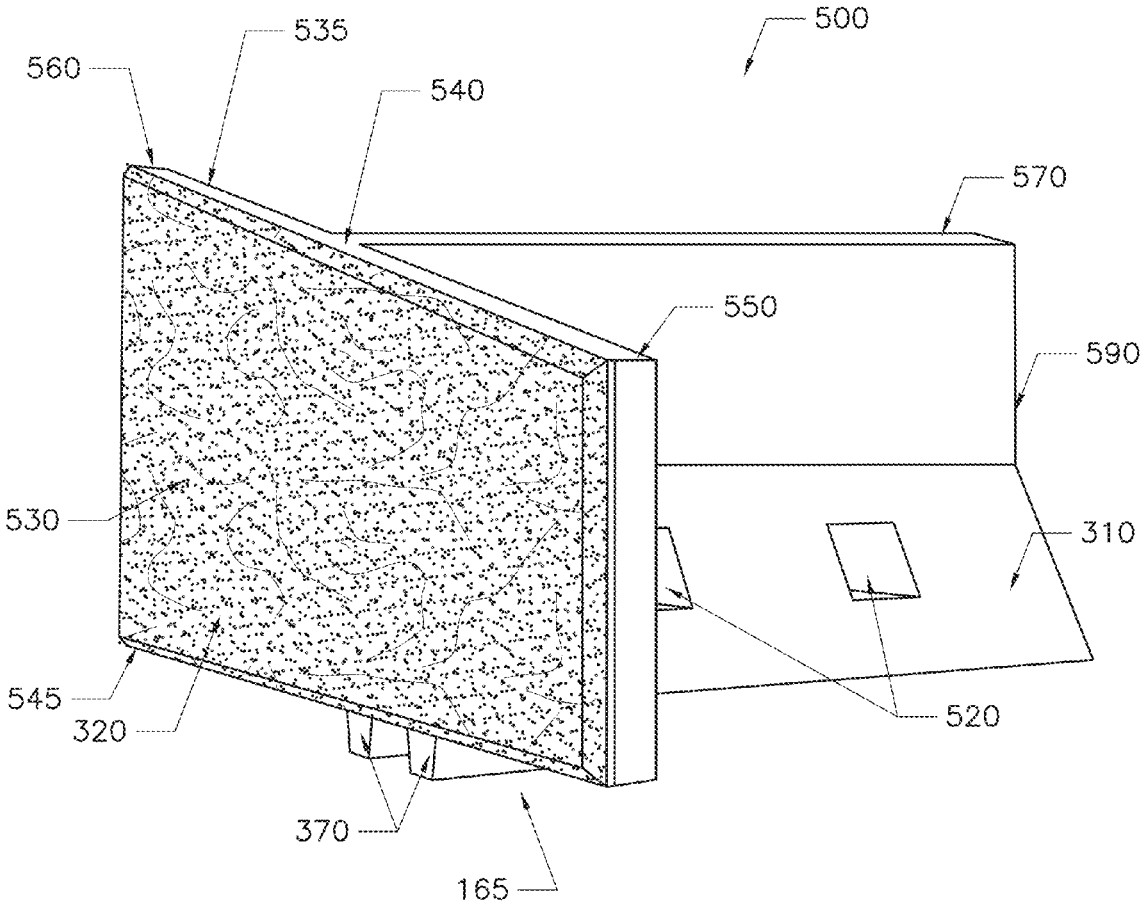
FIG. 13 is a view of the exemplary precast leveling segment in accordance various first embodiments of the disclosure.

Referring to FIG. 13, shown is an exemplary precast leveling segment 500. The precast leveling segment 500 has a front portion 320, horizontal stem 590, and an alignment seat 165. The front portion 320 comprises a front surface 530, a rear surface 535, a top surface 540, and a bottom surface 545. The top surface 540 may slope in parallel to an above roadway. The bottom surface 545 is parallel to an underlying earth retaining wall. For example, the top surface 540 may run parallel to a roadway above the precast leveling segment 500 that slopes from the left side 560 to the right side 550 whereas the bottom surface 545 may run parallel to an underlying earth retaining wall that does not slope. In this example, the top surface 540 is not parallel to the bottom surface 545 but the bottom surface 545 is perpendicular to the front surface 530. Continuing the example, the height of the left side 560 is greater than the height of the right side 550 to facilitate the top surface 540 running parallel to the roadway above. Allowing the top surface 540 to run parallel to the roadway and the bottom surface 545 to run parallel to the underlying earth retaining wall prevents the need to slope the underlying earth retaining wall.

The horizontal stem 590 extends outwardly from a rear surface 535 of the front portion 320. The horizontal stem 590 comprises a triangular portion 310 extending left and right from the top surface 570 of the horizontal stem 590. The triangular portion 310 of the horizontal stem 590 helps capture the weight of the surrounding backfill soil to add resisting force by means of downward weight on the precast leveling segment 500. Two open boxed cavities 520 are cast into the lower section of the precast leveling segment 500 to allow lifting for placement. The alignment seat 165 has right and left aligning elements 370 that align the leveling segment to an underlying earth retaining wall.

FIG. 13 depicts an isometric view to illustrate that the triangular portion 310 of the horizontal stem 590 covers approximately 50% of the overall area of backfill soil that is available to provide weight for overturning resistance. The triangular portion 310 allows a reduced horizontal coverage area and saves precast concrete area and/or volume.

Figure 14:
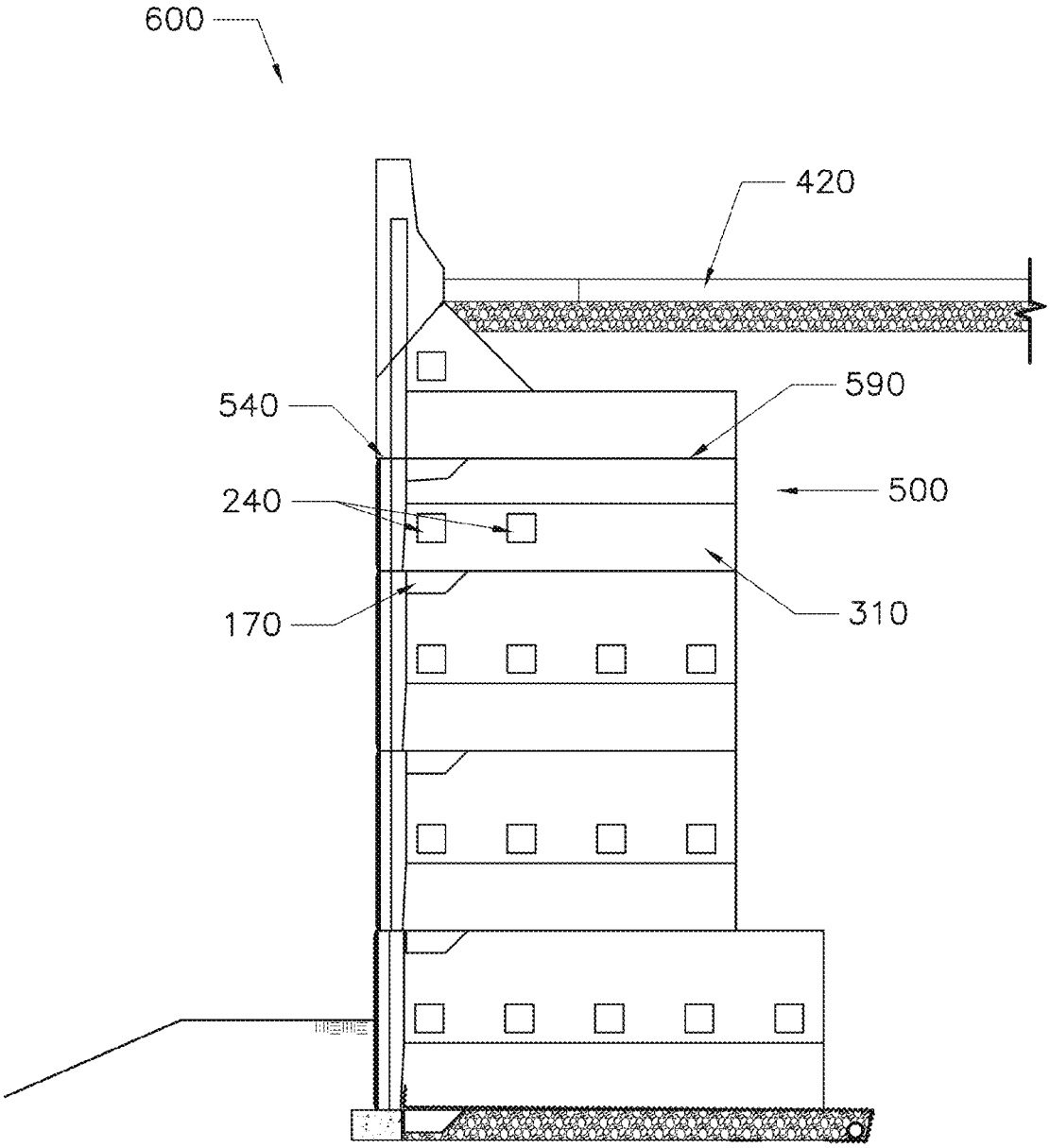
FIG. 14 is a cross sectional view of an earth retaining wall with the exemplary precast leveling segment of FIG. 13 sitting as the top course of an earth retaining wall in accordance various embodiments of the disclosure and just underneath the traffic barrier course.

In reference to FIG. 14, a cross section 600 of a sloping elevated roadway grade 420 is shown sitting on top of an earth retaining wall. The elevated roadway grade 420 slopes toward the viewer of FIG. 14. The top surface 540 of the front portion of the precast leveling segment 500 slopes toward the viewer of FIG. 14 parallel to the elevated roadway grade 420. One of two protrusions 170 is shown. The protrusion 170, along with the other, nonvisible protrusion, locks into the precast segment below. A horizontal stem 590 comprises at least a triangular portion 310 and square holes 240. For installation of a precast leveling segment 500, two square holes 240 are cast into the precast leveling segment 500 for lifting and hoisting the precast leveling segment 500 into place. A horizontal stem 590 parallel to the traffic barrier above is required to transfer downward vertical pressure from a traffic barrier above to the horizontal stem 590 below the precast leveling segment 500.

Figure 15:
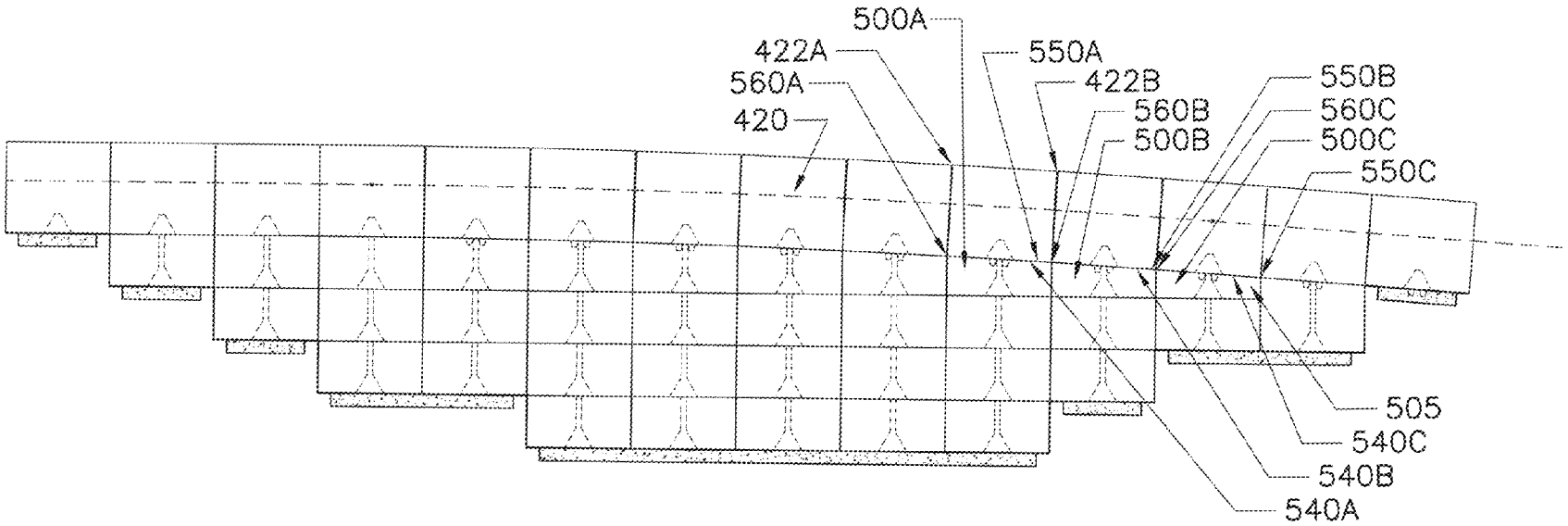
FIG. 15 is an elevation view of an earth retaining wall with the exemplary precast leveling segment of FIG. 13 making up the second from the top row of precast concrete segments in accordance various embodiments of the disclosure.

FIG. 15 depicts an elevation view of the front face of the earth retaining wall. A leveling course 505 of precast leveling segments 500*a*, 500*b*, and 500*c* makes up the designated row below the elevated roadway grade 420. Although many precast leveling segments are depicted, the leveling course 505 may comprise one or more precast leveling segments. The top surfaces 540*a*, 540*b*, and 540*c* of the precast leveling segments 500*a*, 500*b*, and 500*c* slope parallel to the sloping elevated roadway grade 420. Thus, the front surface heights of left edges 560*a*, 560*b*, and 560*c* and right edges 550*a*, 550*b*, and 550*c* of each of the precast leveling segments 500*a*, 500*b*, and 500*c* may increase or decrease relative to the precast leveling segments 500*a*, 500*b*, and 500*c* immediately to the left or right as the elevated roadway grade 420 increases or decreases. The precast leveling segments are in an order that maintains a predefined distance between the elevated roadway grade 420 and the top surfaces 540*a*, 540*b*, and 540*c*. For example, the distance between a point at the top of the left edge 560*a* and a point 422*a* on the roadway that is on a line parallel to the left edge 560*a* equals the distance between a point at the top of the right edge 550*a* and a point 422*b* on the roadway that is on a line parallel to the right edge 550*a*. In one embodiment, the first front surface height of the right edge 550*a* of a first precast leveling segment 500*a* is greater than a second front surface height of the right edge 550*b* of a second precast leveling segment 500*b*. Therefore, the top surfaces 540*a* and 540*b* slope parallel to the elevated roadway grade 420 above the leveling course 505. The precast leveling segments 500*a*, 500*b*, and 500*c* are aligned such that the height of the right edge 550*a* of the first precast leveling segment 500*a* is within a predefined delta of the height of the left edge 560*b* of the second precast leveling segment 500*b* to ensure a gradual slope parallel to the elevated roadway grade 420 above. In alternative embodiments, the height of the left edge 560*b* may be greater than the height of left edge 560*a* when the elevated roadway grade 420 increases slope or the height of the left edge 560*b* may be less than the height of left edge 560*a* when the elevated roadway grade 420 decreases slope.

Figure 16:
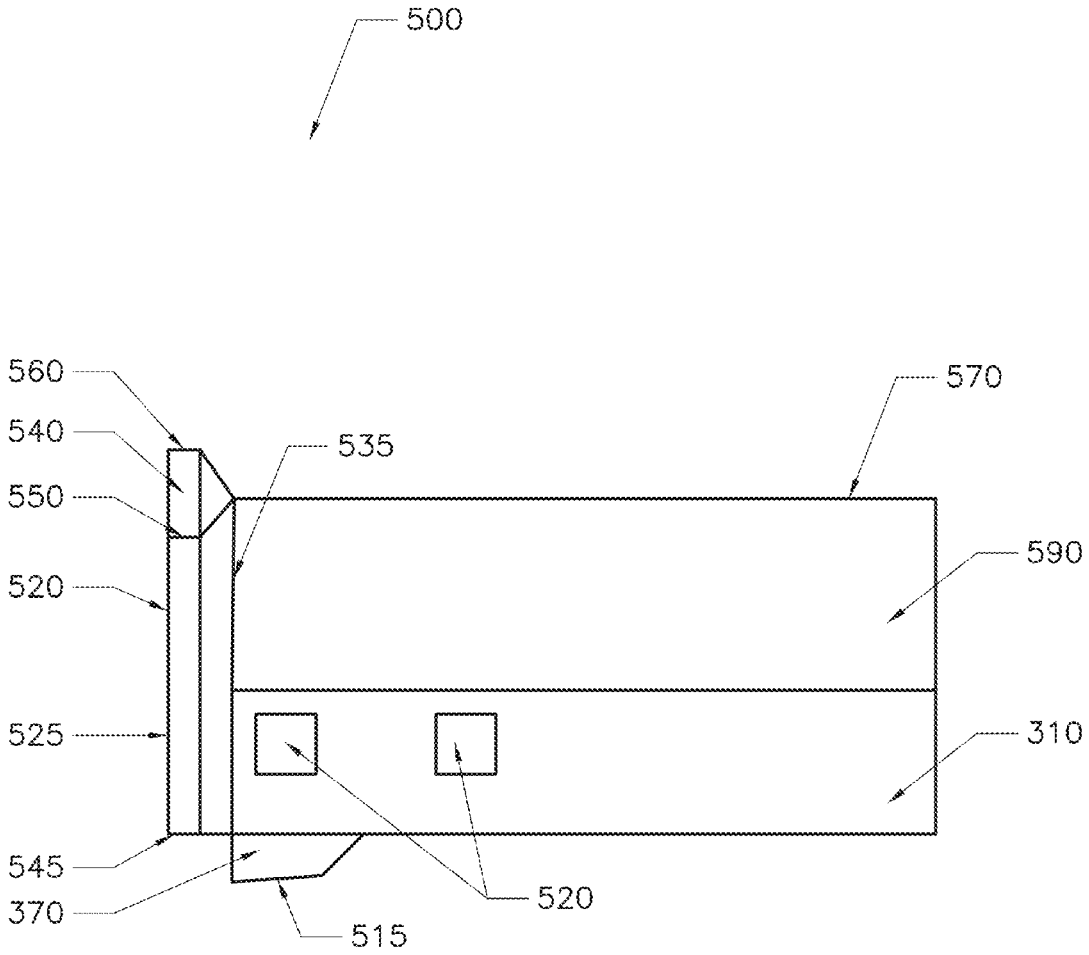
FIG. 16 is a side view of the exemplary precast leveling segment of FIG. 13 in accordance various embodiments of the disclosure.

In FIG. 16, a side view of a precast leveling segment 500 is shown. Shown is a front portion 520, horizontal stem 590, and alignment seat 515. The front portion 530 comprises a front surface 525, a top surface 540, a rear surface 535, and a bottom surface 545. The horizontal stem 590 attaches to the rear surface 535 of the front portion 520. The top surface 540 slopes downward, with a greater height of the left edge 560 than the height of the right edge 550. The horizontal stem 590 comprises a top surface 570 and a triangular portion 310. Two square holes 520 are cast into the horizontal stem 590 of the precast leveling segment 500 for lifting and hoisting the precast leveling segment 500 into place. The alignment seat 515 comprises at least lower aligning elements 370 that extend below the horizontal stem 310 to lock in to the earth retaining wall system below. The lower aligning elements 370 may be locking lugs.

It should be emphasized that the above-described embodiments of the present invention, particularly, any "preferred" embodiments, are merely possible non-limiting examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

Therefore, at least the following is claimed:

1. A precast leveling segment placed above a top portion of an underlying concrete earth retaining wall and below a sloped roadway, the precast leveling segment comprising:

a front portion comprising a front surface, a rear surface, a top surface, and a bottom surface, wherein:

the front surface is parallel to the rear surface;

the top surface is parallel to the sloped roadway;

the bottom surface is perpendicular to the front surface; and the top surface is nonparallel to the bottom surface;

a horizontal stem extending outwardly from the rear surface of the front portion and extending from the top surface to the bottom surface, a lower portion of the horizontal stem comprising a triangular portion extending outwardly from a first side and a second side of the horizontal stem, and the triangular portion of the horizontal stem comprising one or more cavities disposed along a face of at least one side of the triangular portion; and an alignment seat extending along at least a portion of the horizontal stem, the alignment seat being configured to lock into the underlying retaining wall system, wherein the underlying concrete earth retaining wall is not level with the sloped roadway, and wherein the precast leveling segment is situated between a traffic barrier segment and the underlying concrete earth retaining wall, at least a portion of the traffic barrier segment being above the sloped roadway.

2. The precast leveling segment of claim 1, wherein the front surface has a left edge and a right edge.

3. The precast leveling segment of claim 2, wherein:

a left edge of the front portion is perpendicular to the bottom surface;

a right edge of the front portion is perpendicular to the bottom surface;

the left edge is non-perpendicular to the top surface; and the right edge is non-perpendicular to the top surface.

4. The precast leveling segment of claim 2, wherein a left edge height of the left edge is nonequal to a right edge height of the right edge.

5. The precast leveling segment of claim 2, wherein a left edge distance between a left edge top point on the left edge and the roadway is equivalent to a right edge distance between a right edge top point on the right edge and the roadway.

6. A leveling course comprising a series of a plurality of precast leveling segments defined in claim 1.

7. The leveling course of claim 6, wherein the series of the plurality of precast leveling segments comprises a plurality of the precast leveling segments, the respective one of the plurality of front surfaces of each one of the plurality of precast leveling segments aligned adjacent and parallel to other ones of the plurality of front surfaces of the plurality of precast leveling segments.

8. An earth retaining wall comprising:

at least one precast leveling segment, comprising:

a front portion extending from a top surface to a bottom surface, the front portion comprising at least a left edge and a right edge, wherein a right edge height of the right edge is nonequal to a left edge height of the left edge, and the top surface of the front portion being parallel to a sloped roadway situated above the at least one precast leveling segment;

a horizontal stem extending outwardly from a rear surface of the front portion, a lower portion of the horizontal stem comprising a triangular portion extending outwardly from a first side and a second side of the horizontal stem, the triangular portion comprising one or more cavities disposed along a face of at least one side of the triangular portion; and an alignment seat extending downwardly from at least a portion of the horizontal stem;

at least one precast standard segment situated below the at least one precast leveling segment, a top surface of the at least one precast standard segment being parallel to a bottom surface of the at least one precast leveling segment and being nonparallel to the top surface of the at least one precast leveling segment; and at least one traffic barrier segment disposed above the at least one precast leveling segment, at least a portion of the at least one traffic barrier segment being above the sloped roadway.

9. The earth retaining wall of claim 8, wherein the alignment seat joins the at least one precast leveling segment to the at least one precast standard segment of the earth retaining wall.

10. A leveling course comprising a plurality of the at least one precast leveling segment of claim 8, wherein the respective front portion of each one of the plurality of precast leveling segments is aligned with the respective front portion of other ones of the plurality of precast leveling segments.

11. A leveling course comprising at least one precast leveling segment, the at least one precast leveling segment comprising at least:

a top surface parallel to a sloped roadway situated above the precast leveling segment;

a bottom surface parallel to a top precast block segment of a substantially level underlying earth retaining wall situated below the precast leveling segment; and a horizontal stem extending outwardly from a rear surface of a front portion of the at least one precast leveling segment, wherein the horizontal stem extends from the top surface to the bottom surface, a lower portion of the horizontal stem comprising a triangular portion extending outwardly from a first side and a second side of the horizontal stem, and the triangular portion of the horizontal stem comprising one or more cavities disposed along a face of at least one side of the triangular portion, wherein the at least one precast leveling segment is situated between a precast roadway barrier segment and the substantially level underlying earth retaining wall, and wherein a top plane of the substantially level underlying earth retaining wall is nonparallel to the sloped roadway.

12. The leveling course of claim 11, wherein the top surface is nonparallel to the bottom surface.

13. The leveling course of claim 11, further comprising a plurality of heights corresponding to a distance between a plurality of points on the top surface and respective ones of a plurality of points on the bottom surface.

14. The leveling course of claim 13, wherein each one of the plurality of heights equals a distance between the bottom surface at a bottom surface point corresponding to a respective one of the plurality of points along the top surface and the roadway at a roadway point corresponding to the respective one of the plurality of points on the top surface.

15. The leveling course of claim 11, wherein the at least one precast leveling segment further comprises an alignment seat comprising at least one aligning element extending downwardly from at least a portion of the horizontal stem.

16. The leveling course of claim 15, wherein the alignment seat interlocks the at least one precast leveling segment with at least one precast segment of the earth retaining wall.

17. The earth retaining wall of claim 8, wherein individual barrier segments of the at least one traffic barrier segment comprise:

a front barrier portion comprising a front surface, a rear surface, a first side surface, and a second side surface, wherein a first portion of the front surface is situated above the sloped roadway and a second portion of the front surface is situated below the sloped roadway; and a rear stem extending outwardly from the rear surface of the barrier segment.

18. The earth retaining wall of claim 17, wherein the individual ones of the at least one traffic barrier segment further comprise a vertical node protruding outwardly from the first side surface of the front barrier portion, and a groove situated within the second side surface of the front barrier portion such that the vertical node of a first traffic barrier segment is configured to interlock with another groove of a second leveling barrier segment situated adjacent to the first traffic barrier segment.

* * * * *